US007002607B2

(12) United States Patent
Cho

(10) Patent No.: US 7,002,607 B2
(45) Date of Patent: Feb. 21, 2006

(54) APPARATUS AND METHOD FOR COMPENSATING IMAGE BLOCKING ARTIFACTS

(75) Inventor: Bong-hwan Cho, Gyunggi-do (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 459 days.

(21) Appl. No.: 10/274,390

(22) Filed: Oct. 21, 2002

(65) Prior Publication Data

US 2003/0076339 A1 Apr. 24, 2003

(30) Foreign Application Priority Data

Oct. 23, 2001 (KR) ..... 2001-0065226

(51) Int. Cl.
*G09G 3/36* (2006.01)
*G09G 5/10* (2006.01)

(52) U.S. Cl. ..... 345/690; 345/87

(58) Field of Classification Search ..... 345/690–697, 345/77, 89

See application file for complete search history.

(56) References Cited

U.S. PATENT DOCUMENTS 5,337,160 A * 8/1994 Jones ..... 358/447
5,699,078 A * 12/1997 Yamazaki et al. ..... 345/89
5,714,974 A * 2/1998 Liu ..... 345/694
6,034,663 A * 3/2000 Killebrew et al. ..... 345/596
6,133,902 A * 10/2000 Ohkubo et al. ..... 345/690
6,295,041 B1 * 9/2001 Leung et al. ..... 345/89
6,333,727 B1 * 12/2001 Mizumaki ..... 345/89
6,441,829 B1 * 8/2002 Blalock et al. ..... 345/690
6,753,837 B1 * 6/2004 Ham ..... 345/88
6,765,551 B1 * 7/2004 Nakano et al. ..... 345/89

* cited by examiner

*Primary Examiner*—Xiao Wu
*Assistant Examiner*—M. Fatahiyar
(74) *Attorney, Agent, or Firm*—Sughrue Mion, PLLC

(57) ABSTRACT

An apparatus and a method for compensating image blocking artifacts are capable of eliminating image blocking artifacts occurring in consecutively input image signals, in advance. The apparatus for compensating image blocking artifacts has a video signal comparing unit for comparing gradation values of video signals which are consecutively input at a predetermined time interval, the video signal comparing unit determining if the difference between the gradation values meets a certain condition, as the image blocking artifacts occur in the consecutively input video signals; and an operation processing unit for removing the image blocking artifacts by adding/subtracting the gradation values of the input video signals when it is determined that the image blocking artifacts occur. By eliminating the image blocking artifacts occurring in the consecutively input image signals, the image blocking artifact compensating apparatus can provide a clearer video on the liquid crystal display.

10 Claims, 4 Drawing Sheets

APPARATUS AND METHOD FOR COMPENSATING IMAGE BLOCKING ARTIFACTS

BACKGROUND OF THE INVENTION

1. Field of the Invention

The present invention generally relates to an apparatus and method for compensating image blocking artifacts, and more particularly to an apparatus and a method for compensating image blocking artifacts occurring in display systems like Liquid Crystal Displays (LCD). The present application is based on Korean Patent Application No. 2001-65226, which is incorporated herein by reference.

2. Description of the Prior Art

Generally, display devices like liquid crystal displays (LCD), plasma display systems, and light-emitting diodes (LED) display images by controlling on/off of a plurality of pixels arranged in matrixes. Such display devices, which perform the on/off control on the respective pixels, are only capable of displaying images in two ways, namely light on/light off or transparent/nontransparent.

FIG. 1 is a view schematically showing a cell structure of a general LCD. Referring to FIG. 1, a plurality of pixels are arranged in a 4×9 matrix. Each pixel is categorized into a major pixel 11 and a minor pixel 13. The ratio of the major pixel 11 to the minor pixel 13 in regard to the intensity of radiation is 8:1, and the major pixel 11 and the minor pixel 13 are driven in time series by the expression of gradation. For example, if the gradation is fifteen (15), the minor pixel 13 is driven fifteen (15) times. If the gradation is sixteen (16), the major pixel 11 is driven two (2) times. In the example shown in FIG. 1, minor pixels 13 are driven from the first to third columns, the major pixels 11 are driven from the fourth to the sixth columns, and the minor pixels 13 are driven from the seventh to the ninth columns.

Conventionally, each pixel is driven in time series, and occasionally, a situation occurs in which the consecutively driven pixels are perceived by the user's eyes with a gradation that is different from the actual gradation. Such a situation will be called 'image blocking artifacts' hereinbelow. When the image blocking artifacts happen, the user may perceive two consecutive columns as one column. And he/she may perceive the respective columns of pixels by the order of 15 gradation, 15 gradation, 31 gradation, 16 gradation, 0 gradation, 15 gradation and 15 gradation. Accordingly, from the user's view, the user will perceive dark 31 gradation at an instance when the major pixel 11 is driven after the minor pixel 13 is driven. Then, at the instance when the minor pixel 13 is driven after the major pixel 11 is driven, the user will perceive 0 gradation, which will cause the interruption between lines.

SUMMARY OF THE INVENTION

The present invention has been made to overcome the above-mentioned problems of the prior art. Accordingly, it is an object of the present invention to provide an apparatus and a method for compensating image blocking artifacts, which are caused due to the structure of a display device like a liquid crystal display.

The above object is accomplished by an apparatus for compensating image blocking artifacts according to the present invention, including a video signal comparing unit for comparing gradation values of video signals which are consecutively input at a predetermined time interval, the signal comparing unit determining if the difference between the gradation values meets a certain condition, as the image blocking artifacts occur in the consecutively input video signals; and an operation processing unit for removing the image blocking artifacts by adding/subtracting the gradation values of the input video signals when it is determined that the image blocking artifacts occur.

The video signal comparing unit comprises an index generating unit for generating an index for commanding an adding/subtracting of the gradation values of the video signals that are input to the operation processing unit when it is determined that the image blocking artifacts occur.

The operation processing unit comprises a video signal modulating unit for modulating the input video signals, so that resultant gradation values of adding/subtracting can be output.

When a gradation value of a preceding video signal of the consecutively input video signals meets a certain condition, the video signal comparing unit compares the gradation values of the consecutively input video signals.

When a remainder of dividing the gradation value of the preceding video signal by a predetermined number equals a predetermined value, the video signal comparing unit compares the gradation values of the consecutively input video signals.

According to the present invention, the apparatus for compensating image blocking artifacts compares gradation values of sequentially input video signals. When there is a possibility of having image blocking artifacts, the apparatus minimizes the image blocking artifacts by adding or subtracting a predetermined gradation value with respect to the gradation value of the input signals.

According to the present invention, a method for compensating image blocking artifacts comprises the steps of comparing gradation values of video signals that are consecutively input at a predetermined time interval; determining when a difference between the gradation values meets a certain condition, as the image blocking artifacts occur in the video signals; and when determining that the image blocking artifacts occur, removing the blocking artifacts by adding/subtracting the gradation values of the consecutively input video signals.

BRIEF DESCRIPTION OF THE DRAWINGS

The above-mentioned object and the feature of the present invention will be more apparent by describing the preferred embodiment of the present invention by referring to the appended drawings, in which.

DETAILED DESCRIPTION OF THE PREFERRED EMBODIMENT

From now on, the present invention will be described in greater detail by referring to the appended drawings.

Figure 1:
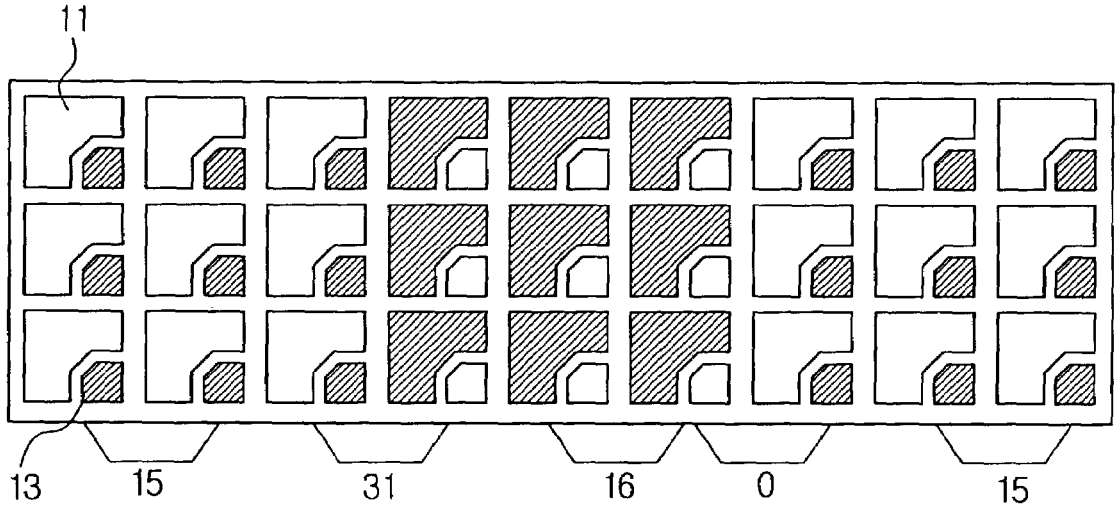
FIG. 1 (PRIOR ART)
FIG. 1 is a view schematically showing the cell structure of a conventional liquid crystal display.
Figure 2:
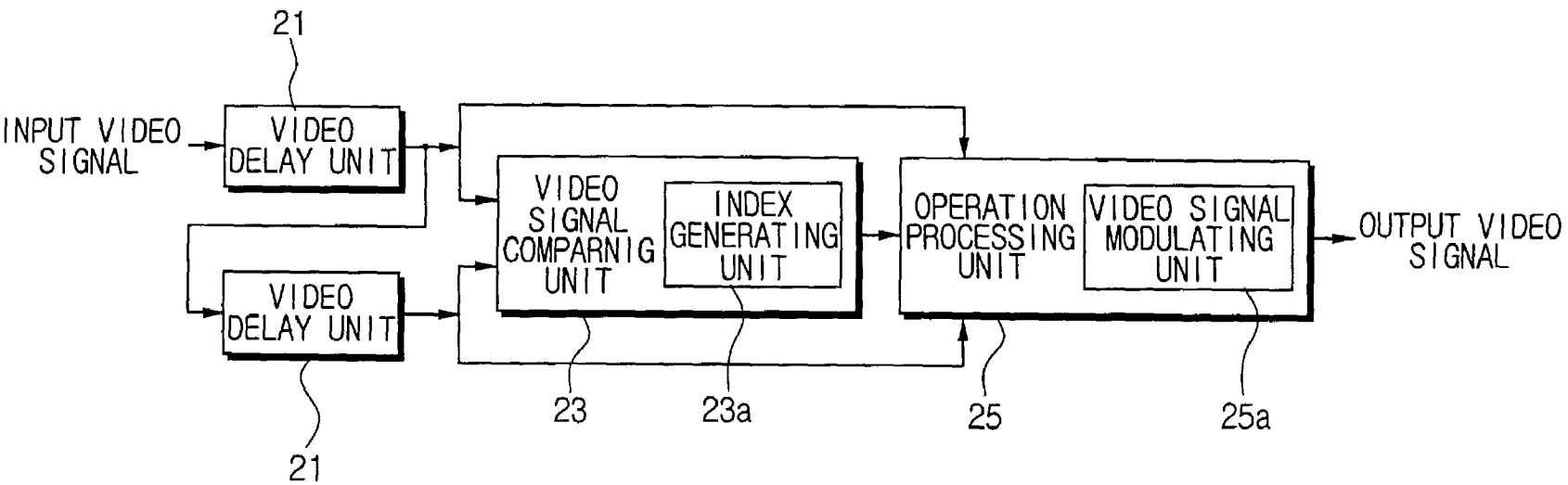
FIG. 2 is a block diagram schematically showing an apparatus for compensating image blocking artifacts according to the present invention.

FIG. 2 schematically shows the apparatus for compensating the image blocking artifacts according to the present invention. As shown in FIG. 2, the image blocking artifacts compensating apparatus includes an image delay unit 21, a video signal comparing unit 23 and an operation processing unit 25. The video signal comparing unit 23 has an index generating unit 23*a*. Also, the operation processing unit 25 has a video signal modulating unit 25*a*.

The image delay unit 21 delays an input video signal by a predetermined time period. The predetermined delay time made by the image delay unit 21 is preferably set to be as much as the time interval at which each frame of the video signal is input. Further, it is preferred that the image delay unit 21 be constructed in a first-in first-out type buffer, in which the image delay unit 21 temporarily stores the input video signal for a predetermined time before outputting the signal.

The video signal comparing unit 23 compares the gradation values of the video signals that are consecutively input at a predetermined time interval. The video signal comparing unit 23 determines if the difference between the compared video signals meets a certain condition, as there are image blocking artifacts occurring between the consecutively input video signals.

When it is determined by the video signal comparing unit 23 that there are image blocking artifacts occurring in the consecutively input video signals, the index generating unit 23*a* generates an index that gives a command to add/subtract the gradation values of the video signals that are input to the operation processing unit 25, to eliminate the possibility of having the image blocking artifacts.

When it is determined that there is a possibility of having image blocking artifacts in the consecutively input video signals, the operation processing unit 25 adds/subtracts the gradation values of the input video signals, to thereby eliminate the possibility of having the image blocking artifacts.

Figure 3:
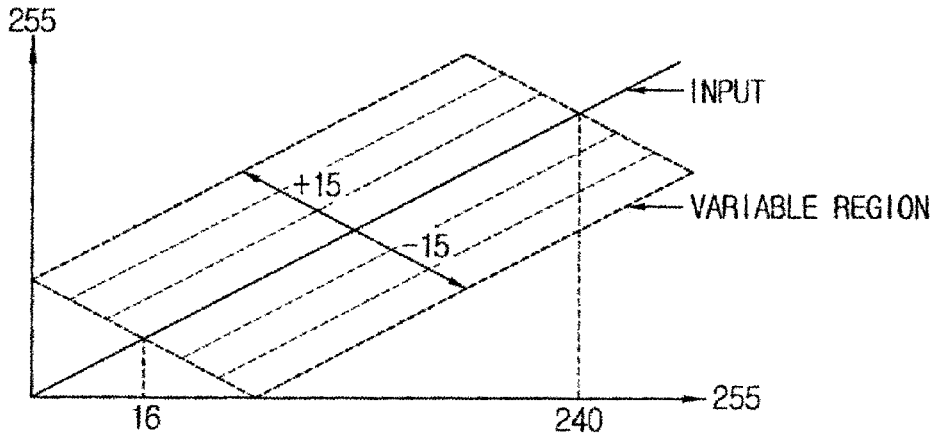
FIG. 3 is a view showing a variable region of a gradation that is displayable in pixels.

When it is determined that there is a possibility of having image blocking artifacts in the consecutively input video signals, the video signal modulating unit 25*a* modulates the input video signals so that the input video signals can be output with the resultant gradation values of adding or subtracting by the operation processing unit 25. FIG. 3 shows the available range of gradation values that can be added/subtracted to modulate the input video signals, when it is determined that there is a possibility of having the image blocking artifacts in the consecutively input video signals. The general range of gradation is between 14 and 241.

Figure 4:
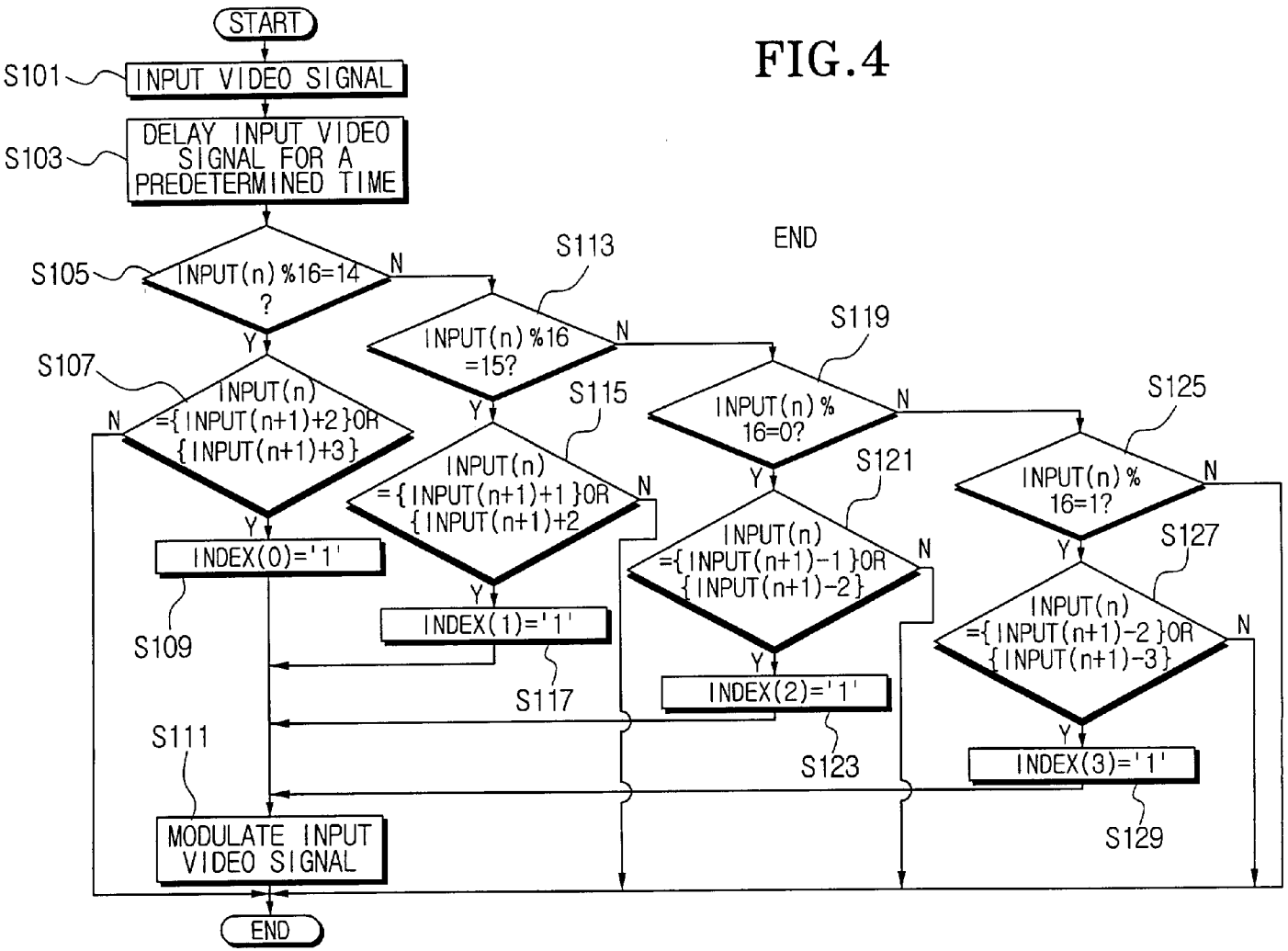
FIG. 4 is a flowchart for illustrating a process of compensating image blocking artifacts of FIG. 2.

FIG. 4 is a flowchart showing the process of compensating the image blocking artifacts of FIG. 2. Referring to FIG. 4, first, video signals in a frame unit are input to the image blocking artifact compensating apparatus consecutively (step S103). As mentioned above, the input video signals have the gradation value ranging from 14 to 241. Among the input video signals, the preceding input signals are delayed for a predetermined time so that the preceding signals can be input to the video signal comparing unit 23 together with the following input signals.

The image delay unit 21 delays the input video signals for a predetermined time (step S103). The image delay unit 21 can be achieved by a first-in/first-out type buffer. The video signals, which are delayed by the image delay unit 21, are input to the video signal comparing unit 23 together with the following input signals that are not delayed. The delayed input video signals and non-delayed input video signals are input to the video signal comparing unit 23 together with each other. Alternatively, once-delayed and twice-delayed input video signals can be input to the video signal comparing unit 23. The video signals, which are consecutively input to the video signal input unit 23, have to be input to the video signal comparing unit 23 at the same time.

The video signal comparing unit 23 determines whether the remainder of dividing the gradation value of the preceding input video signal corresponds to a certain value or not (steps S105, S113, S119, S125). If the remainder of dividing the gradation value of the preceding input video signal corresponds to the certain value, the video signal comparing unit 23 determines whether the resultant gradation value of adding or subtracting a certain gradation value with respect to the gradation value of the following input video signal corresponds to the gradation value of the preceding input video signal or not (steps S107, S115, S121, S127). In other words, the video signal comparing unit 23 determines whether the difference between the gradation value of the preceding input video signal and the gradation value of the following input video signal meets a certain condition or not.

When it is determined that the resultant gradation value of adding or subtracting a certain gradation value with respect to the gradation value of the following input video signal corresponds to the gradation value of the preceding input video signal, i.e., when it is determined that the difference between the gradation value of the preceding input video signal and the gradation value of the following input video signal corresponds to a certain value, the index generating unit 23*a* generates the respective indexes (steps S109, S117, S123, S129). The indexes generated by the index generating unit 23*a* are transmitted to the operation processing unit 25. The video signal comparing unit 23 transmits the preceding input video signal and the following input video signal to the operation processing unit 25 so that the image blocking artifacts occurring in the consecutively input video signals can be compensated.

The operation processing unit 25 receives the indexes from the index generating unit 23*a*, and adds/subtracts the gradation value of the input video signal to eliminate the possibility of having the image blocking artifacts in the input video signals. At this time, based on the received indexes, the operation processing unit 25 determines whether to add or subtract the gradation value of the input video signals. Also, the video signal modulating unit 25*a* of the operation unit 25 modulates the input video signals so that the input video signals can be output with the gradation values of the video signals that are added/subtracted by the operation processing unit 25 (step S111). Either the preceding input video signal or the following input video signal can be modulated. Alternatively, both of the preceding and following input video signals can be modulated.

When it is determined that the resultant gradation value of adding or subtracting a certain gradation value with respect to the gradation value of the following input video signal does not meet the gradation value of the preceding input video signal, the video signal comparing unit 23 terminates the image blocking artifact compensating process, and stands by for the process of compensating the image blocking artifacts of the next input video signals.

When it is determined that the remainder of dividing the gradation value of the preceding input video signal by a predetermined value does not correspond to any of the preset values, the video signal comparing unit 23 terminates the process of compensating the image blocking artifacts of the input video signal, and stands by for the process of compensating the image blocking artifacts with respect to the next input video signals.

FIG. 4 shows an example of image blocking artifact compensation, which is performed when the remainder of dividing the gradation values of the input video signal by sixteen (16) corresponds to any of 14, 15, 0 and 1. It is based on the fact that there is a high possibility of having the image blocking artifacts when the remainders of dividing the gradation values of the consecutively input video signals by sixteen (16) falls into the range of +2~−2. However, it does not necessarily mean that the image blocking artifacts are compensated only when the remainder of dividing the gradation value of the input video signal by sixteen (16) corresponds to any of 14, 15, 0 and 1.

As described above, whether the difference between the gradation values of the consecutively input video signals is two (2) or three (3) is determined according to the remainder of dividing the gradation values of the input video signals by sixteen (16). However, it should be noted that it is just based on the fact that the difference of 2 or 3 between the gradation values of the consecutively input video signals indicates a high possibility of having the image blocking artifacts. Accordingly, one does not necessarily have to use certain limited figures to compensate the image blocking artifacts.

As described above, the image blocking artifact compensating apparatus according to the present invention reduces occurrence of image blocking artifacts by compensating to prevent occurrence of the image blocking artifacts between the video signals that are consecutively input in a frame unit.

Although the preferred embodiment of the present invention has been described, it will be understood by those skilled in the art that the present invention should not be limited to the described preferred embodiment, but various changes and modifications can be made within the spirit and scope of the present invention as defined by the appended claims.

What is claimed is:

1. An apparatus for compensating image blocking artifacts, comprising:

a video signal comparing unit for comparing gradation values of video signals which are consecutively input at a predetermined time interval, the video signal comparing unit determining if a remainder of dividing the gradation value of a preceding input video signal by a predetermined number corresponds to a first predetermined value, and if the difference between the gradation values corresponds to a second predetermined value, as the image blocking artifacts occur in the consecutively input video signals; and an operation processing unit for removing the image blocking artifacts by adding/subtracting the gradation values of the input video signals when it is determined that the image blocking artifacts occur.

2. The apparatus for compensating image blocking artifacts as claimed in claim 1, wherein the video signal comparing unit comprises an index generating unit for generating an index for commanding an adding/subtracting of the gradation values of the video signals that are input to the operation processing unit when it is determined that the image blocking artifacts occur.

3. The apparatus for compensating image blocking artifacts as claimed in claim 2, wherein the operation processing unit comprises a video signal modulating unit for modulating the input video signals so that resultant gradation values of adding/subtracting can be output.

4. The apparatus for compensating image blocking artifacts as claimed in claim 3, wherein, when a remainder of dividing a gradation value of a preceding video signal of the consecutively input video signals by a predetermined number corresponds to the first predetermined value, the video signal comparing unit compares the gradation values of the consecutively input video signals.

5. The apparatus for compensating image blocking artifacts as claimed in claim 1, wherein, when a remainder of dividing a gradation value of a preceding video signal of the consecutively input video signals by a predetermined number corresponds to the first predetermined value, the video signal comparing unit compares the gradation values of the consecutively input video signals.

6. A method for compensating image blocking artifacts, comprising the steps of:

comparing gradation values of video signals that are consecutively input at a predetermined time interval;

determining if a remainder of dividing the gradation value of a preceding input video signal by a predetermined number corresponds to a first predetermined value, and if the difference between the gradation values corresponds to a second predetermined value, as the image blocking artifacts occur in the video signals; and when determining that the image blocking artifacts occur, removing the blocking artifacts by adding/subtracting the gradation values of the consecutively input video signals.

7. The method for compensating image blocking artifacts as claimed in claim 6, further comprising the step of generating an index for commanding an adding/subtracting of the gradation values of the video signals that are input to an operation processing unit.

8. The method for compensating image blocking artifacts as claimed in claim 7, further comprising the step of modulating the video signals so that the gradation values that are added to/subtracted from can be output.

9. The method for compensating image blocking artifacts as claimed in claim 8, wherein the comparing step is performed only when a remainder of dividing a gradation value of a preceding video signal of the consecutively input video signals by a predetermined number corresponds to the first predetermined value.

10. The method for compensating image blocking artifacts as claimed in claim 6, wherein the comparing step is performed only when a remainder of dividing a gradation value of a preceding video signal of the consecutively input video signals by a predetermined number corresponds to the first predetermined value.

* * * * *